US011495181B2

(12) United States Patent
Kim et al.

(10) Patent No.: US 11,495,181 B2
(45) Date of Patent: Nov. 8, 2022

(54) DISPLAY DEVICE AND DRIVING METHOD THEREOF

(71) Applicant: Samsung Display Co., Ltd., Yongin-Si (KR)

(72) Inventors: Soon-Dong Kim, Osan-si (KR); Sangan Kwon, Cheonan-si (KR); Changnoh Yoon, Seoul (KR); Seungjae Lee, Suwon-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/317,071

(22) Filed: May 11, 2021

(65) Prior Publication Data

US 2022/0068220 A1 Mar. 3, 2022

(30) Foreign Application Priority Data

Sep. 1, 2020 (KR) ..... 10-2020-0111127

(51) Int. Cl.
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2310/027* (2013.01); *G09G 2320/0285* (2013.01)

(58) Field of Classification Search
CPC ..... G09G 3/3291; G09G 3/3266; G09G 2310/027; G09G 2320/0285
See application file for complete search history.

(56) References Cited

U.S. PATENT DOCUMENTS

| | | | | |
|---|---|---|---|---|
| 9,633,608 | B2 | 4/2017 | Shin | |
| 9,997,096 | B2 | 6/2018 | Shin | |
| 2021/0027686 | A1* | 1/2021 | Roh | G09G 3/20 |
| 2021/0407431 | A1 | 12/2021 | Kim et al. | |

FOREIGN PATENT DOCUMENTS

| | | | |
|---|---|---|---|
| KR | 1020150069850 | A | 6/2015 |
| KR | 1020150134167 | A | 12/2015 |
| KR | 1020180018898 | A | 2/2018 |
| KR | 1020220001037 | A | 1/2022 |

* cited by examiner

*Primary Examiner* — Kenneth B Lee, Jr.
(74) *Attorney, Agent, or Firm* — Cantor Colburn LLP

(57) ABSTRACT

The display device includes a display panel in which a first display area and a second display area adjacent to the first display area are defined, a data driving circuit which drives the plurality of data lines, a scan driving circuit which drives the plurality of scan lines, and a driving controller which receives an image signal and a control signal, and controls the data driving circuit and the scan driving circuit based on an operation mode, where the driving controller includes a luminance deviation compensation unit which compensates for luminance deviation of the first display area and the second display area when the operation mode is a multi-frequency mode in which the first display area is driven at a first frequency and the second display area is driven at a second frequency different from the first frequency.

20 Claims, 11 Drawing Sheets

DISPLAY DEVICE AND DRIVING METHOD THEREOF

This application claims priority to Korean Patent Application No. 10-2020-0111127, filed on Sep. 1, 2020, and all the benefits accruing therefrom under 35 U.S.C. § 119, the content of which in its entirety is herein incorporated by reference.

BACKGROUND

1. Field

The disclosure herein relates to a display device and a driving method thereof, and more particularly, to a display device capable of multi-frequency driving and a driving method thereof.

2. Description of the Related Art

Among display devices, an organic light-emitting display device displays an image using an organic light emitting diode that generates light by recombination of electrons and holes. Such an organic light emitting diode display has desired characteristics including a fast response speed and relatively low power consumption.

Organic light emitting display devices include pixels connected to data lines and scan lines. Pixels generally include an organic light emitting diode and a circuit unit for controlling an amount of current flowing through the organic light emitting diode. The circuit unit controls the amount of current flowing from a first driving voltage to a second driving voltage through an organic light emitting diode in response to a data signal, such that light having a predetermined luminance is generated in response to the amount of current flowing through the organic light emitting diode.

When a video is displayed on the display device, as the driving frequency is higher, the display quality of the video is better. However, a display device operating at a high driving frequency increases power consumption.

SUMMARY

The disclosure provides a display device and a method of driving the display device in which luminance deviation between display areas generated by multi-frequency driving is compensated.

An embodiment of the invention provides a display device including: a display panel including a plurality of pixels connected to a plurality of data lines and a plurality of scan lines, where a first display area and a second display area adjacent to the first display area are defined in the display panel; a data driving circuit which drives the plurality of data lines; a scan driving circuit which drives the plurality of scan lines; and a driving controller which receives an image signal and a control signal, and controls the data driving circuit and the scan driving circuit based on an operation mode, where the driving controller includes a luminance deviation compensation unit which compensates for luminance deviation of the first display area and the second display area when the operation mode is a multi-frequency mode in which the first display area is driven at a first frequency and the second display area is driven at a second frequency different from the first frequency.

In an embodiment, the driving controller may further include a first lookup table and a second lookup table each provides image data signals to the luminance deviation compensation unit, where the image data signals from the first lookup table may correspond to the first display area, and the image data signals from the second lookup table may correspond to the second display area.

In an embodiment, the first lookup table may provide a first image data signal corresponding to the first frequency, and the second lookup table may provide a second image data signal corresponding to the second frequency.

In an embodiment, the driving controller may determine the operation mode as the multi-frequency mode when the received image signal includes a video signal and a still image signal, where the luminance deviation compensation unit may provide the first image data signal to the first display area of the display panel, in which a video corresponding to the video signal is displayed, and provide the second image data signal to the second display area of the display panel, in which a still image corresponding to the still image signal is displayed, in the multi-frequency mode.

In an embodiment, the first frequency may be greater than the second frequency, and a voltage of the first image data signal may be greater than a voltage of the second image data signal.

In an embodiment, when the operation mode is a normal frequency mode, the driving controller may drive both of the first display area and the second display area at the first frequency every frame during the normal frequency mode, and provide a first image data signal corresponding to the first frequency to the first display area and the second display area of the display panel.

In an embodiment, the luminance deviation compensation unit may include: a still image signal determination unit which detects a video signal and a still image signal from the received image signal; an operation mode determination unit which determines the operation mode as a multi-frequency mode when it is determined that the received image signal includes the video signal and the still image signal; and an image data signal providing unit which provides different image data signals to the first display area and the second display area, respectively, when the operation mode is determined as the multi-frequency mode.

In an embodiment, the still image signal determination unit may determine the still image signal by comparing the image signal of a previous frame with the image signal of a current frame.

In an embodiment, in the multi-frequency mode, the display device may display a video corresponding to the video signal in the first display area and display a still image corresponding to the still image signal in the second display area.

In an embodiment, the image data signal providing unit may provide a first image data signal to the first display area and a second image data signal to the second display area, wherein a data voltage of the second image data signal may be less than a data voltage of the first image data signal.

In an embodiment, the driving controller may further include a first lookup table which provides a first image data signal and a second lookup table which provides a second image data signal to the luminance deviation compensation unit, where the image data signal providing unit may provide the first image data signal from the first lookup table to the first display area of the display panel and provide the second image data signal from the second lookup table to the second display area.

In an embodiment, when it is determined that the received image signal does not include the still image signal, the operation mode determination unit may determine the operation mode as a normal frequency mode in which both of the first display area and the second display area are driven at the first frequency every frame, where the image data signal providing unit may provide a first image data signal corresponding to the first frequency to the first display area and the second display area of the display panel.

In an embodiment of the invention, a display device includes: a display panel including a plurality of pixels connected to a plurality of data lines and a plurality of scan lines; a data driving circuit which drives the plurality of data lines; a scan driving circuit which drives the plurality of scan lines; and a driving controller which receive an image signal and a control signal and controls the data driving circuit and the scan driving circuit to display an image on the display panel, where the driving controller divides the display panel into a first display area driven at a first frequency and a second display area driven at a second frequency lower than the first frequency based on the image signal, and sets a first maximum grayscale value applied to the first display area and a second maximum grayscale value applied to the second display area differently from each other.

In an embodiment, when a still image signal is detected from the image signal, the driving controller may determine an operation mode as a multi-frequency mode.

In an embodiment, the driving controller may change the first maximum grayscale value or the second maximum grayscale value based on a target luminance value in the multi-frequency mode.

In an embodiment, the driving controller may provide a first image data signal corresponding to the first maximum grayscale value and a second image data signal corresponding to the second maximum grayscale value to the data driving circuit.

In an embodiment, the display panel may be foldable based on a folding axis extending in a predetermined direction in a folding area.

In an embodiment of the invention, a method of driving a display device includes: performing an image data signal receiving operation by receiving, by a luminance deviation compensation unit, a first image data signal and a second image data signal to compensate for a luminance deviation occurring between a first display area of a display panel driven at a first frequency and a second display area of the display panel driven at a second frequency different from the first frequency; and performing an image data signal providing operation by providing, by the luminance deviation compensation unit, the first image data signal and the second image data signal to the first display area and the second display area of the display panel, respectively.

In an embodiment, the performing the image data signal receiving operation may include: detecting, by a still image signal determination unit, a still image signal among image signals received by a driving controller; determining, by an operation mode determination unit, an operation mode of the driving controller as a multi-frequency mode when the still image signal is detected; and receiving, by an image data signal providing unit, the first image data signal from a first lookup table and providing the first image data signal to the first display area, and receiving, by the image data signal providing unit, the second image data signal from a second lookup table and providing the second image data signal to the second display area when the multi-frequency mode is determined.

In an embodiment, the performing the image data signal providing operation may include: converting the first image data signal and the second image data signal into a first image data voltage and a second image data voltage, respectively; and applying the first image data voltage and the second image data voltage to the first display area and the second display area of the display panel, respectively.

BRIEF DESCRIPTION OF THE DRAWINGS

The above and other features of the invention will become more apparent by describing in further detail embodiments thereof with reference to the accompanying drawings, in which.

DETAILED DESCRIPTION

Figure 1A:
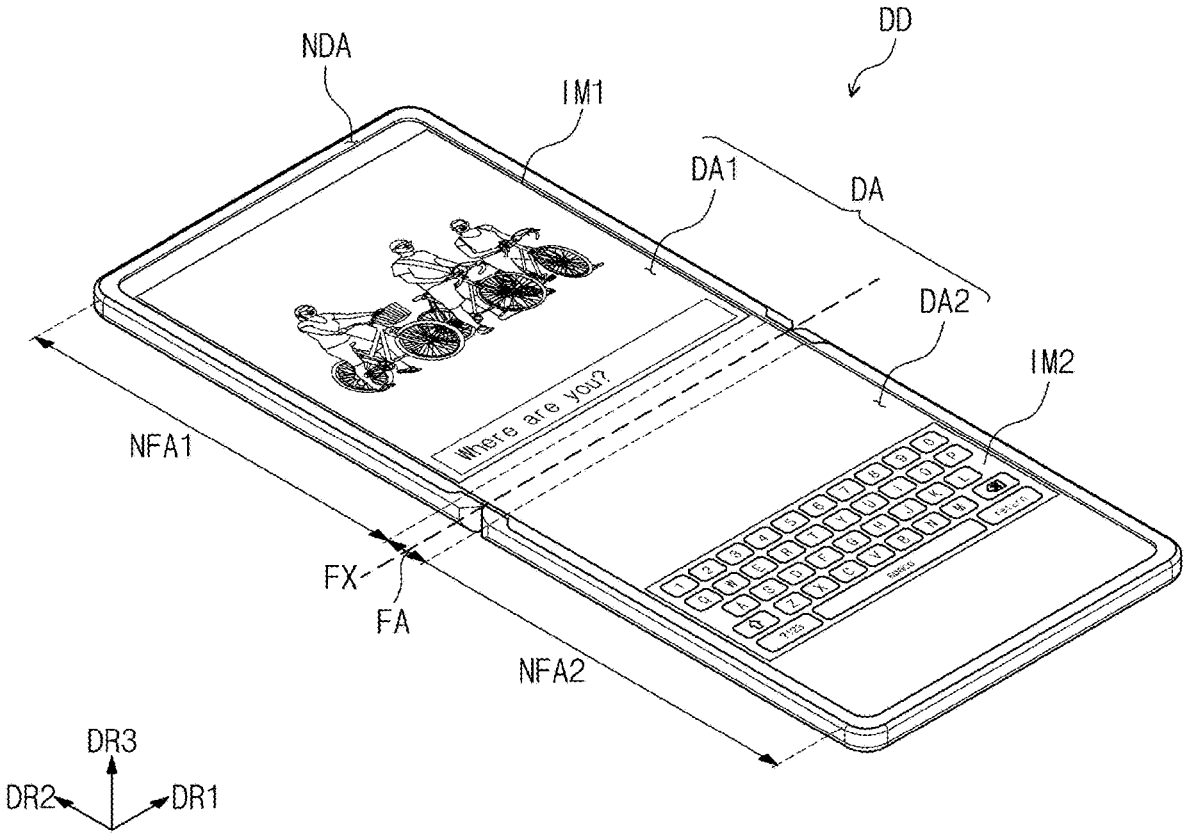
FIG. 1A is a perspective view of a display device according to an embodiment of the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

In this specification, when an element (or region, layer, part, etc.) is referred to as being "on", "connected to", or "coupled to" another element, it means that it can be directly placed on/connected to/coupled to the other components, or intervening elements may be present therebetween. In contrast, when an element is referred to as being "directly on", "connected directly to", or "coupled directly to" another element, there are no intervening elements present.

Like reference numerals refer to like elements. Additionally, in the drawings, the thicknesses, proportions, and dimensions of components are exaggerated for effective description.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

It will be understood that the terms "first" and "second" are used herein to describe various components but these components should not be limited by these terms. The above terms are used only to distinguish one component from another. For example, a first component may be referred to as a second component and vice versa without departing from the scope of the invention. The terms of a singular form may include plural forms unless otherwise specified.

In addition, terms such as "below", "the lower side", "on", and "the upper side" are used to describe a relationship of components shown in the drawing. The terms are described as a relative concept based on a direction shown in the drawing.

Unless otherwise defined, all terms (including technical and scientific terms) used herein have the same meaning as commonly understood by one of ordinary skill in the art to which this invention belongs. In addition, terms defined in a commonly used dictionary should be interpreted as having a meaning consistent with the meaning in the context of the related technology, and unless interpreted in an ideal or overly formal sense, the terms are explicitly defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the invention will be described in detail with reference to the accompanying drawings.

Figure 1B:
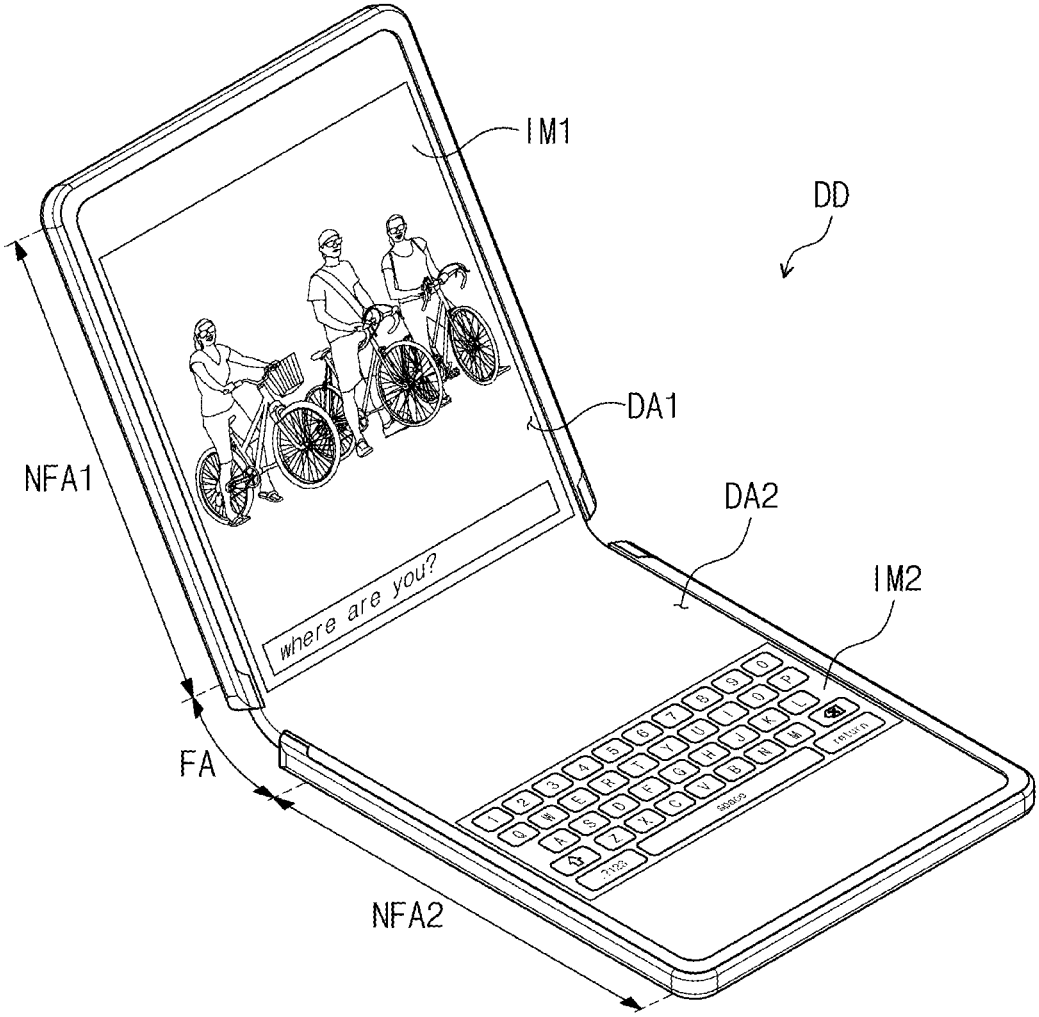
FIG. 1B is a perspective view of a display device according to an embodiment of the invention.

FIG. 1A is a perspective view of a display device according to an embodiment of the invention. FIG. 1B is a perspective view of a display device according to an embodiment of the invention. FIG. 1A illustrates a state in which the display device DD is unfolded, and FIG. 1B illustrates a state in which the display device DD is folded.

FIGS. 1A and 1B illustrate an embodiment where the display device DD is a mobile phone. However, the invention is not limited thereto. The display device DD may include a tablet personal computer ("PC"), a smart phone, a personal digital assistant ("PDA"), a portable multimedia player ("PMP"), a game console, and a wrist watch type electronic device. Embodiments of the invention may be used in large electronic equipment such as televisions or external billboards, as well as small and medium-sized electronic equipment such as personal computers, notebook computers, kiosks, car navigation units, and cameras. These are merely exemplary, and may be employed in other electronic devices without departing from the teachings herein.

In an embodiment, the display device DD includes a display area DA and a non-display area NDA. The display device DD may display an image through the display area DA. When the display device DD is unfolded or in an unfolded state, the display area DA may be on a plane defined by the first direction DR1 and the second direction DR2. The thickness direction of the display device DD may be parallel to the third direction DR3 intersecting the first direction DR1 and the second direction DR2. Accordingly, the front (or upper) and rear (or lower) surfaces of the elements constituting the display device DD may be defined with respect to the third direction DR3. The non-display area NDA may be referred to as a bezel area. In one embodiment, for example, the display area DA may have a rectangular shape. In an embodiment, the non-display area NDA surrounds the display area DA.

The display area DA may include a first non-folding area NFA1, a folding area FA, and a second non-folding area NFA2. The folding area FA may be bent based on the folding axis FX extending along the first direction DR1.

When the display device DD is folded, the first non-folding area NFA1 and the second non-folding area NFA2 may face each other. Accordingly, in a fully folded state, the display area DA may not be exposed to an outside, which may be referred to as in-folding. However, the operation of the display device DD is not limited thereto.

In an embodiment of the invention, when the display device DD is folded, the first non-folding area NFA1 and the second non-folding area NFA2 may be opposed to each other. Accordingly, in the folded state, the first non-folding area NFA1 may be exposed to the outside, which may be referred to as out-folding.

In an embodiment, the display device DD may perform only one operation of in-folding and out-folding. Alternatively, the display device DD may perform both an in-folding operation and an out-folding operation. In such an embodiment, a same area of the display device DD, for example, the folding area FA may be in-folded and out-folded. Alternatively, some areas of the display device DD may be in-folded and other areas may be out-folded.

In an embodiment, as shown in FIGS. 1A and 1B, for example, one folding area and two non-folding areas are defined in the display device DD, but the number of folding areas and non-folding areas is not limited thereto. In one alternative embodiment, for example, the display device DD may include more than two non-folding areas and a plurality of folding areas disposed between adjacent non-folding areas.

FIGS. 1A and 1B show an embodiment where the folding axis FX is parallel to the short axis of the display device DD, but the invention is not limited thereto. In one alternative embodiment, for example, the folding axis FX may extend along a long axis of the display device DD, for example, a direction parallel to the second direction DR2. In such an embodiment, the first non-folding area NFA1, the folding area FA, and the second non-folding area NFA2 may be sequentially arranged along the first direction DR1.

A plurality of display areas DA1 and DA2 may be defined in the display area DA of the display device DD. In an embodiment, as shown in FIG. 1A, two display areas DA1 and DA2 may be defined, but the number of the plurality of display areas DA1 and DA2 is not limited thereto.

The plurality of display areas DA1 and DA2 may include a first display area DA1 and a second display area DA2. In one embodiment, for example, the first display area DA1 may be an area where the first image IM1 is displayed, and the second display area DA2 may be an area where the second image IM2 is displayed, but the invention is limited thereto. In one embodiment, for example, the first image IM1 may be a video, and the second image IM2 may be a still image or an image with a long change period (text information, and the like).

In an embodiment, the display device DD may operate differently according to an operation mode. The operation mode may include a normal frequency mode and a multi-frequency mode. The display device DD sets the basic driving frequency (BDF) to the normal frequency (NF) during the normal frequency mode. Accordingly, the display device DD operating in the normal frequency (NF) may drive both the first display area DA1 and the second display area DA2 with the normal frequency (NF). The display device DD may set the basic driving frequency (BDF) to the normal frequency (NF) during the multi-frequency mode (BDF=NF). In such an embodiment, the display device DD may set the basic driving frequency (BDF) to a frequency lower than the normal frequency (NF) during the multi-frequency mode (NF>BDF). The display device DD may drive at a first frequency in the first display area DA1 in which the first image IM1 is displayed during the multi-frequency mode, and may drive the second display area DA2 in which the second image IM2 is displayed at the second frequency. In an embodiment, the first frequency (DF1) may be the same as the basic driving frequency (BDF) (DF1=BDF), and the second frequency (DF2) may be lower than the basic driving frequency (BDF) (DF2<BDF). That is, the first frequency (DF1) may be higher than the second frequency (DF2) (DF1>DF2). In an embodiment, the first frequency (DF1) may be the same as the normal frequency (NF) (DF1=NF).

The sizes of each of the first and second display areas DA1 and DA2 may be preset sizes, and may be changed by an application program. In an embodiment, the first display area DA1 may correspond to the first non-folding area NFA1, and the second display area DA2 may correspond to the second non-folding area NFA2. In addition, a part of the folding area FA may correspond to the first display area DA1, and another part of the folding area FA may correspond to the second display area DA2.

In an embodiment, the first display area DA1 corresponds to a part of the first non-folding area NFA1, and the second display area DA2 may correspond to another part of the first non-folding area NFA1, the folding area FA and the second non-folding area NFA2. That is, the area of the first display area DA1 may be larger than the area of the second display area DA2.

In an embodiment, the first display area DA1 may correspond to a part of the first non-folding area NFA1, the folding area FA and the second non-folding area NFA2, and the second display area DA2 may be another part of the second non-folding area NFA2. That is, the area of the second display area DA2 may be larger than the area of the first display area DA1.

In an embodiment, as shown in FIG. 1B, when the folding area FA is in a folded state, the first display area DA1 may correspond to the first non-folding area NFA1, and the second display area DA2 may correspond to the folding area FA and the second non-folding area NFA2.

FIGS. 1A and 1B illustrate an embodiment of the display device DD where the display device DD is a foldable display device, but the invention is not limited thereto. Embodiments of the invention may be applied to various display devices having a plurality of display areas, e.g., a non-folding display device, a display device having two or more folding areas, or a rollable display device.

Figure 2:
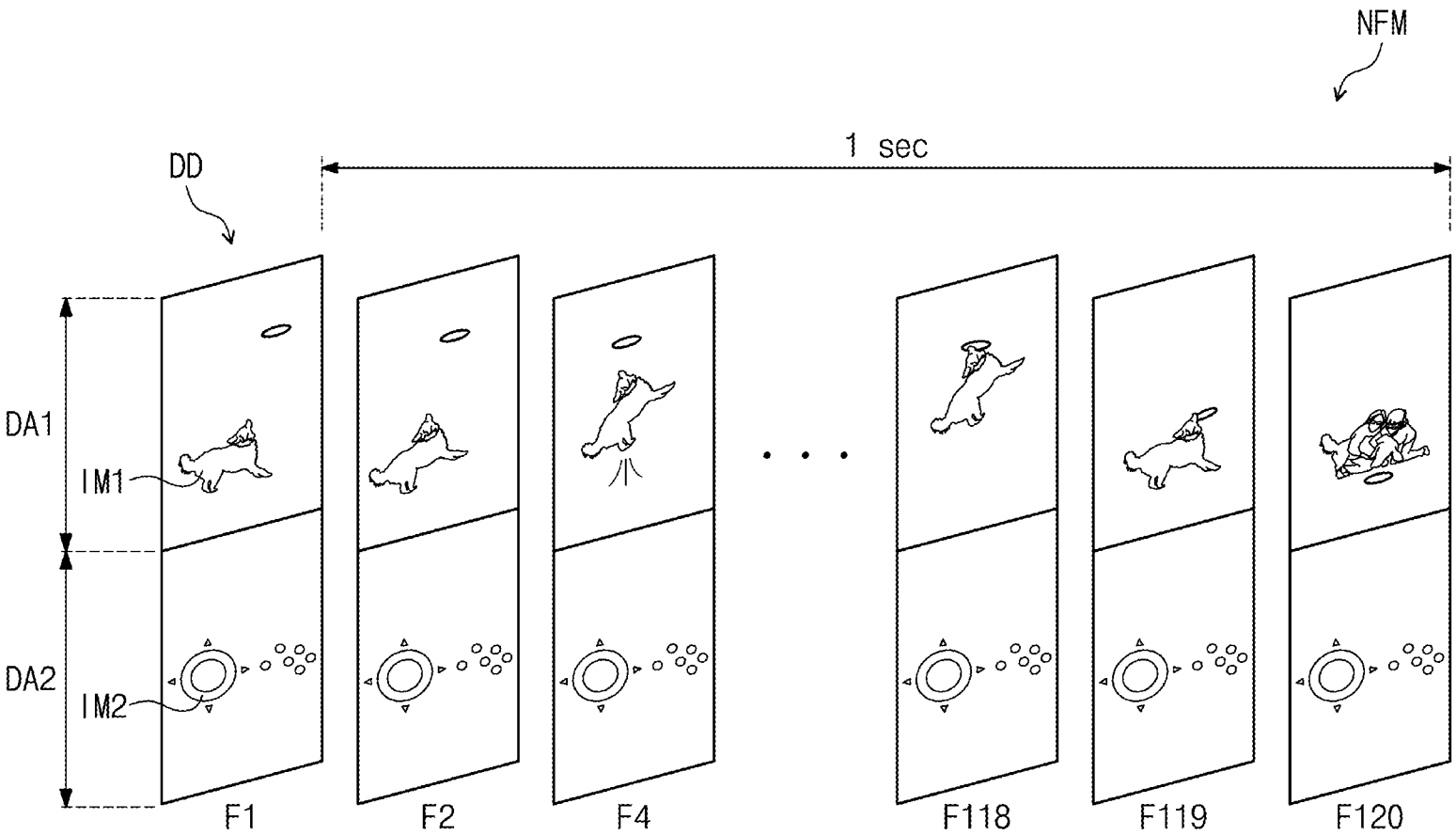
FIG. 2 is a diagram illustrating an operation of a display device in a normal frequency mode.
Figure 3:
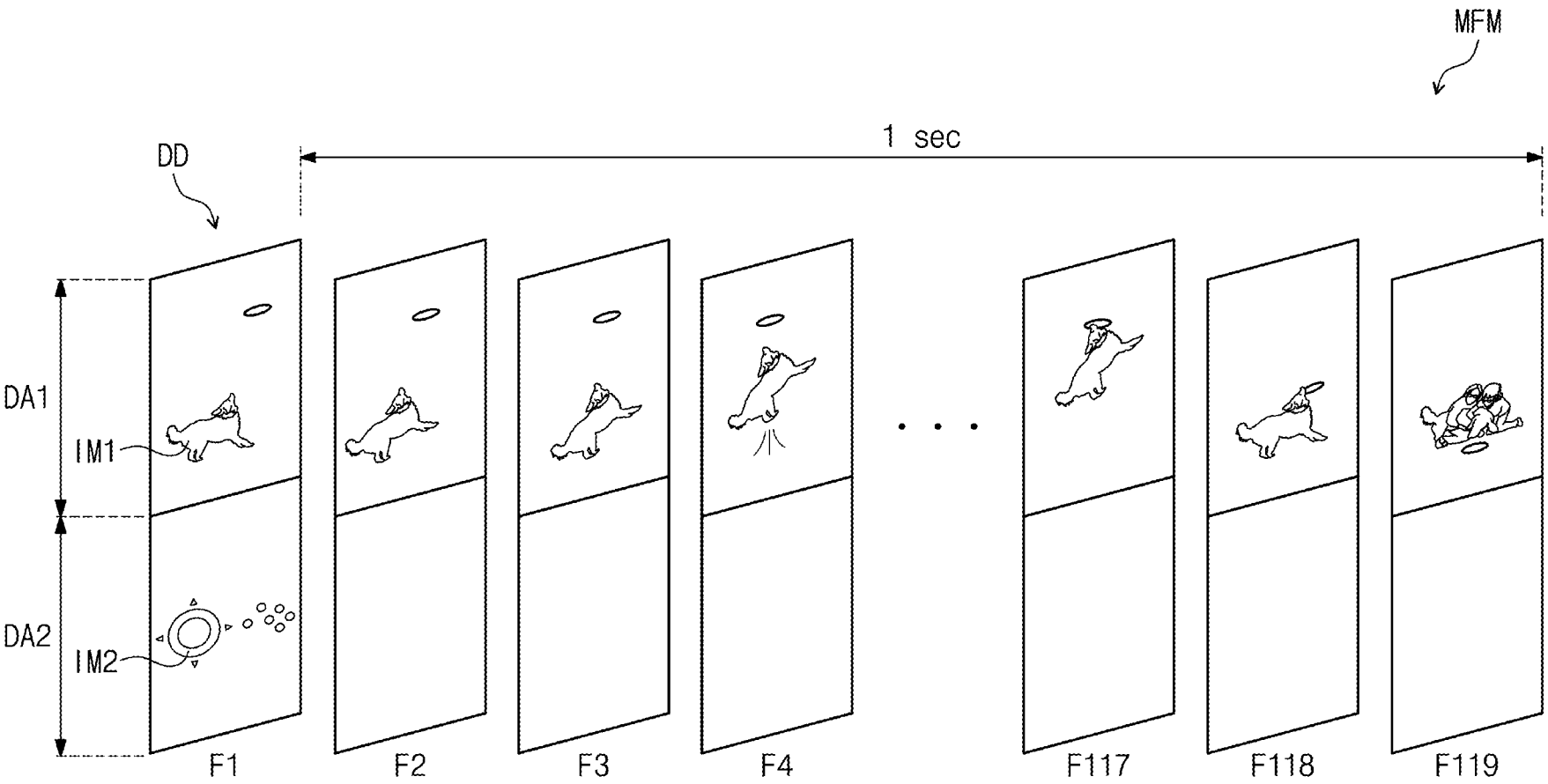
FIG. 3 is a diagram illustrating an operation of a display device in a multi-frequency mode.

FIG. 2 is a diagram illustrating an operation of a display device in a normal frequency mode. FIG. 3 is a diagram illustrating an operation of a display device in a multi-frequency mode.

In an embodiment, referring to FIG. 2, driving frequencies of the first display area DA1 and the second display area DA2 of the display device DD in the normal frequency mode NFM are normal frequencies. In one embodiment, for example, the normal frequency may be 120 hertz (Hz). In the normal frequency mode NFM, images of a first frame F1 to 120th frame F120 may be displayed in the first display area DA1 and the second display area DA2 of the display device DD for 1 second.

Referring to FIG. 3, in the multi-frequency mode MFM, the driving frequency of the first display area DA1 of the display device DD may be a first frequency equal to or lower than the normal frequency, and the driving frequency of the second display area DA2 may be a second frequency lower than the normal frequency. When the normal frequency is 120 Hz, the first driving frequency and the second driving frequency are shown in Table 1 below.

TABLE 1

| First driving frequency | Second driving frequency |
|---|---|
| 80 Hz | 40 Hz |
| 90 Hz | 30 Hz |
| 102 Hz | 18 Hz |
| 110 Hz | 10 Hz |
| 118 Hz | 2 Hz |
| 120 Hz | 1 Hz |

In one embodiment, for example, as shown in FIG. 3, when the first frequency is 120 Hz and the second frequency is 1 Hz in the multi-frequency mode MFM, the first image IM1 is displayed in the first frame F1 to the 120th frame F120 in the first display area DA1 of the display device DD for 1 second, and the second image IM2 may be displayed only in the first frame F1 in the second display area DA2. That is, in the multi-frequency mode MFM, the first image IM1 corresponding to 120 frames is displayed in the first display area DA1 for 1 second, and the second image IM2 corresponding to one frame is displayed in the second display area DA2. In the multi-frequency mode MFM, since an image is not displayed in the second display area DA2, power consumption may be reduced. In such an embodiment, since an image of a first frequency (120 Hz) equal to the normal frequency is displayed in the first display area DA1 in the multi-frequency mode MFM, power consumption may be reduced while minimizing display quality degradation of the display device DD. The first image IM1 may be a video, and the second image IM2 may be a still image.

Figure 4:
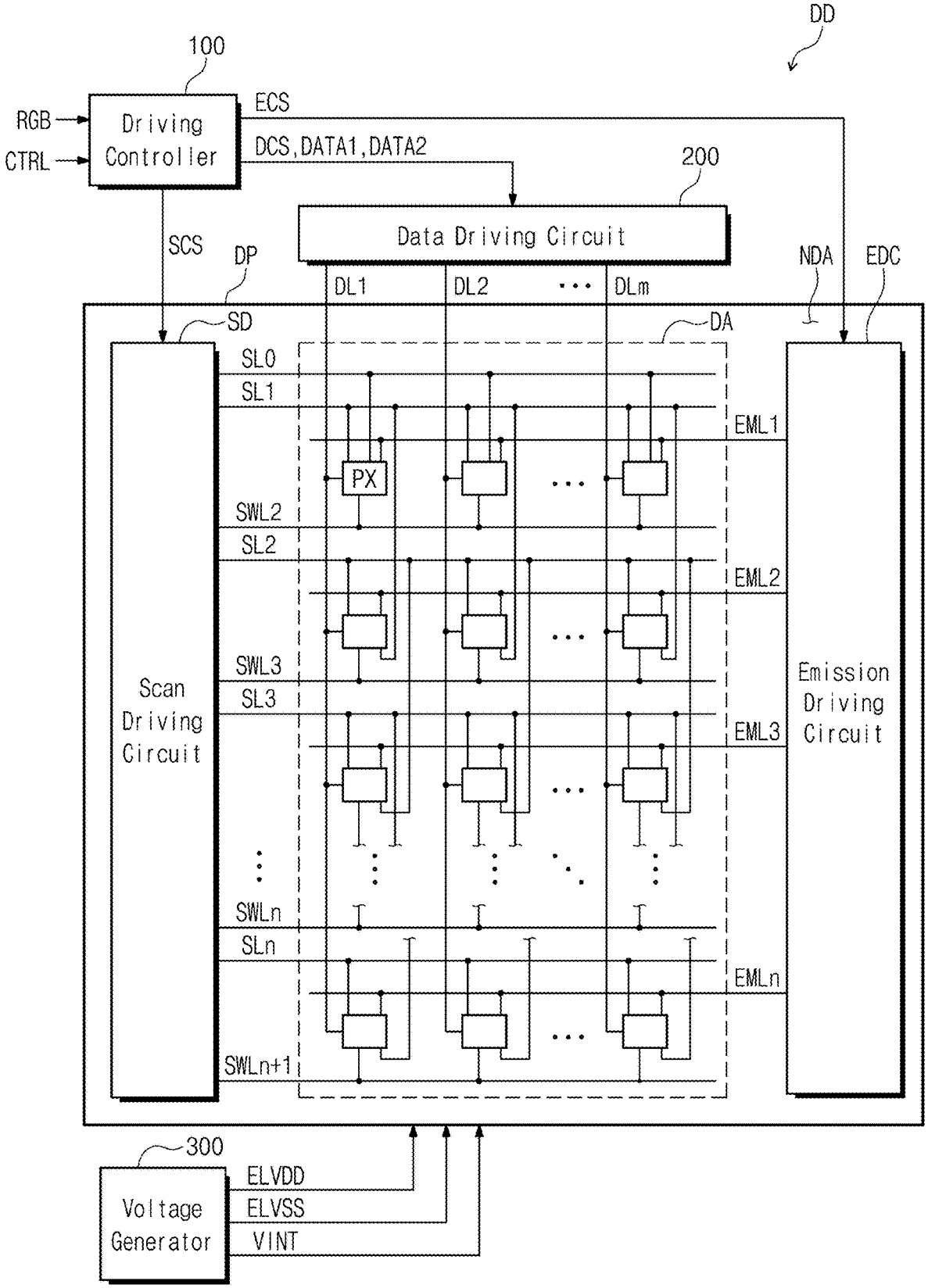
FIG. 4 is a block diagram of a display device according to an embodiment of the invention.

FIG. 4 is a block diagram of a display device according to an embodiment of the invention.

Referring to FIG. 4, an embodiment of a display device DD includes a display panel DP, a driving controller 100, a data driving circuit 200, and a voltage generator 300.

The driving cont 100 receives an image signal RGB and a control signal CTRL. The driving controller 100 converts the image signal RGB to meet the specifications of the interface with the data driving circuit 200, and generates a first image data signal DATA1 and a second image data signal DATA2 for compensating for a luminance deviation between the first area DA1 and the second area DA2. The driving controller 100 outputs a scan control signal SCS, a data control signal DCS, and an emission control signal ECS.

The data driving circuit 200 receives a data control signal DCS and first and second image data signals DATA1 and DATA2 from the driving controller 100. The data driving circuit 200 converts the first and second image data signals DATA1 and DATA2 into data signals, and outputs the data signals to a plurality of data lines DL1 to DLm to be described later. The data signals are analog voltages corresponding to grayscale values of the image data signal DATA.

The voltage generator 300 generates voltages used for the operation of the display panel DP. In an embodiment, the voltage generator 300 generates a first driving voltage ELVDD, a second driving voltage ELVSS, and an initialization voltage VINT.

The display panel DP includes first scan lines SL0 to SLn, second scan lines SWL2 to SWLn+1, emission control lines EML1 to EMLn, data lines DL1 to DLm, and pixels PX. The display panel DP may further include a scan driving circuit SD and an emission driving circuit EDC. In an embodiment, the scan driving circuit SD may be arranged on a first side (or a left side) of the display panel DP. The first scan lines SL0 to SLn and the second scan lines SWL2 to SWLn+1 extend in the first direction DR1 from the scan driving circuit SD.

In an embodiment, the emission driving circuit EDC may be arranged on a second side (or a right side) of the display panel DP. The emission control lines EML1 to EMLn extend in a direction opposite to the first direction DR1 from the emission driving circuit EDC.

The first scan lines SL0 to SLn, the second scan lines SWL2 to SWLn+1, and the emission control lines EML1 to EMLn are arranged to be spaced apart from each other in the second direction DR2. The data lines DL1-DLm extend in a direction opposite to the second direction DR2 from the data driving circuit 200 and are arranged to be spaced apart from each other in the first direction DR1.

In an embodiment, as shown in FIG. 4, the scan driving circuit SD and the emission driving circuit EDC are arranged facing each other with pixels PX interposed therebetween, but the invention is not limited thereto. In one alternative embodiment, for example, the scan driving circuit SD and the emission driving circuit EDC may be disposed adjacent to each other on one of the first side and the second side of the display panel DP. In another alternative embodiment, the scan driving circuit SD and the emission driving circuit EDC may be configured as or integrated into a single circuit.

The pixels PX are electrically connected to the first scan lines SL0 to SLn, the second scan lines SWL2 to SWLn+1, the emission control lines EML1 to EMLn, and the data lines DL1 to DLm, respectively. Each of the pixels PX may be electrically connected to four scan lines. In one embodiment, for example, as shown in FIG. 4, pixels in the first row may be connected to the scan lines SL0, SL1, and SWL2, and the emission control line EML1. In such an embodiment, the pixels in the second row may be connected to the scan lines SL2 and SWL3, and the emission control line EML2.

Each of the plurality of pixels PX includes an organic light emitting diode ED (see FIG. 5) and a pixel circuit unit PXC (see FIG. 5) that controls light emission of the light emitting diode. The pixel circuit unit PXC may include a plurality of transistors and a capacitor. The scan driving circuit SD may include transistors formed through a same process as those of the pixel circuit unit PXC.

Each of the pixels PX receives a first driving voltage ELVDD, a second driving voltage ELVSS, and an initialization voltage VINT.

The scan driving circuit SD receives a scan control signal SCS from the driving controller 100. The scan driving circuit SD may output first scan signals to the first scan lines SL0 to SLn in response to the scan control signal SCS, and output second scan signals to the second scan lines SWL2 to SWLn+1 in response to the scan control signal SCS.

In an embodiment, the driving controller 100 divides the display panel DP into the first display area DA1 (see FIG. 1) and the second display area DA2 (see FIG. 1) based on an image signal RGB, and outputs at least one masking signal indicating the start of the second display area DA2. The at least one masking signal may be included in the scan control signal SCS.

Figure 5:
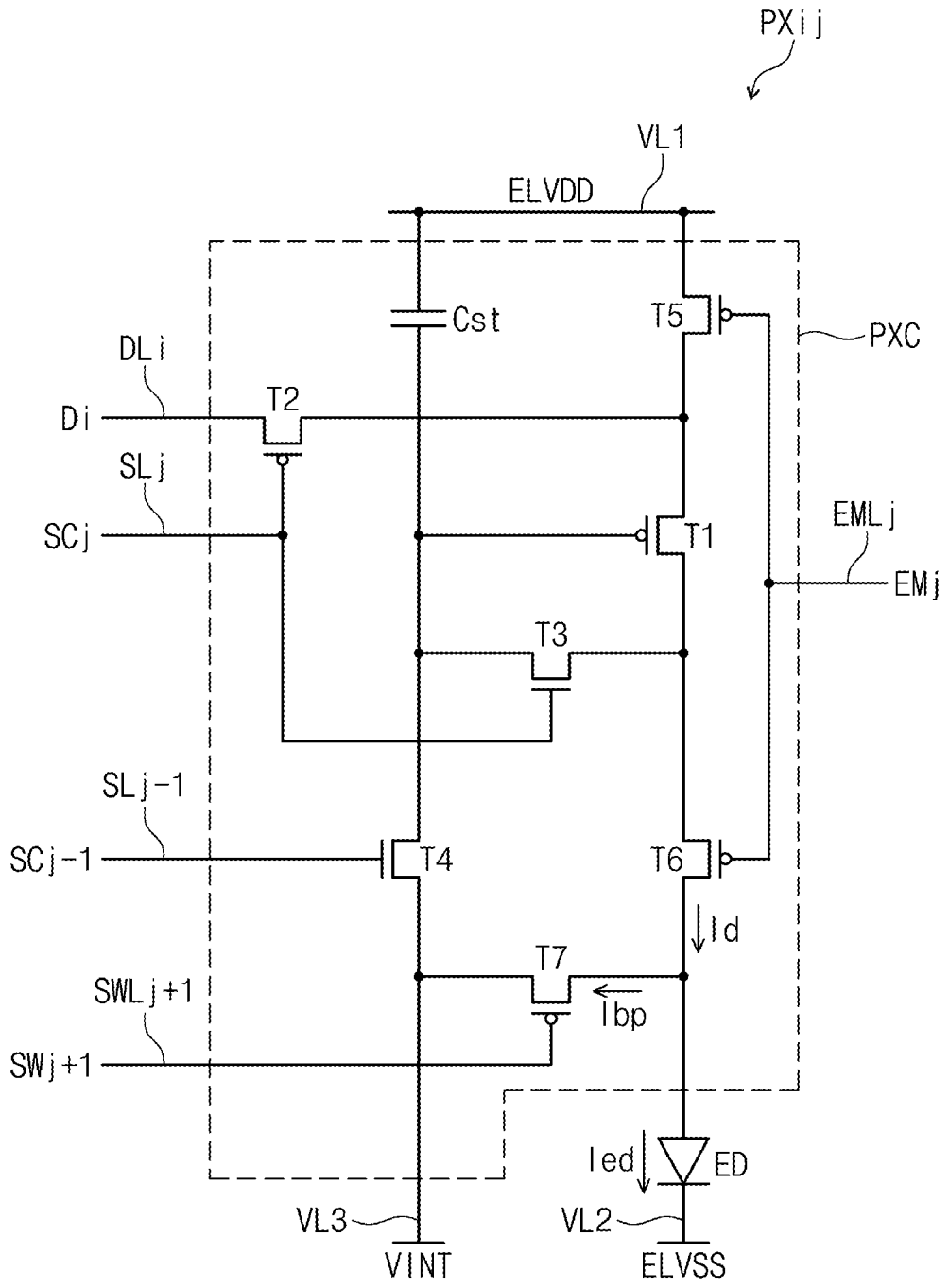
FIG. 5 is an equivalent circuit diagram of a pixel according to an embodiment of the invention.

FIG. 5 is an equivalent circuit diagram of a pixel according to an embodiment of the invention.

FIG. 5 shows an equivalent circuit diagram of an embodiment of a pixel PXij connected to the i-th data line DL1 among the data lines DL1 to DLm, the (j−1)-th first scan line SLj−1 and the j-th first scan line SLj among the first scan lines SL0 to SLn, the (j+1)-th second scan line SWLj+1 among the second scan lines SWL2 to SWLn+1, and the j-th emission control line EMLj among the emission control lines EML1 to EMLn shown in FIG. 4.

Each of the plurality of pixels PX illustrated in FIG. 4 may have a same circuit configuration as the equivalent circuit diagram of the pixel PXij illustrated in FIG. 5. In an embodiment, as shown in FIG. 5, the pixel circuit unit PXC of the pixel PXij includes first to seventh transistors T1 to T7 and one capacitor Cst. In such an embodiment, the third and fourth transistors T3 and T4 of the first to seventh transistors T1 to T7 may be N-type transistors using an oxide semiconductor as a semiconductor layer, and each of the first, second, fifth, sixth, and seventh transistors T1, T2, T5, T6, and T7 may be a P-type transistor having a low-temperature polycrystalline silicon ("LTPS") semiconductor layer. However, the invention is not limited thereto, and the first to seventh transistors T1 to T7 may be entirely P-type transistors or N-type transistors. In an embodiment, at least one of the first to seventh transistors T1 to T7 may be an N-type transistor and the rest of the first to seventh transistors T1 to T7 may be a P-type transistor. Further, the circuit configuration of the pixel according to the invention is not limited to FIG. 5. The pixel circuit unit PXC illustrated in FIG. 5 is merely exemplary, and the configuration of the pixel circuit unit PXC may be variously modified and implemented.

Referring to FIG. 5, an embodiment of a pixel PXij of the display device includes first to seventh transistors T1, T2, T3, T4, T5, T6, and T7, a capacitor Cst, and at least one light emitting diode ED. In such an embodiment, one pixel PXij may include a single light emitting diode ED, as shown in FIG. 5, but not being limited thereto.

The (j−1)-th first scan line SLj−1, the j-th first scan line SLj, the (j+1)-th second scan line SWLj+1, and the j-th emission control line EMLj may transmit the (j−1)-th first scan signal SCj−1, the j-th first scan signal SCj, the (j+1)-th second scan signal SWj+1, and the emission control signal EMj, respectively. The data line DLi transmits the data signal Di. The data signal Di may have a voltage level corresponding to the image signal RGB inputted to the display device DD (refer to FIG. 4). The first to third driving voltage lines VL1, VL2, and VL3 may transmit a first driving voltage ELVDD, a second driving voltage ELVSS, and an initialization voltage VINT, respectively.

The first transistor T1 includes a first electrode connected to the first driving voltage line VL1 through a fifth transistor T5, a second electrode electrically connected to an anode of the light emitting diode ED through the sixth transistor T6, and a gate electrode connected to one end of the capacitor Cst. The first transistor T1 may receive the data signal Di transmitted from the data line DL based on the switching operation of the second transistor T2 and supply the driving current Id to the light emitting diode ED.

The second transistor T2 includes a first electrode connected to the data line DLi, a second electrode connected to the first electrode of the first transistor T1, and a gate electrode connected to the j-th first scan line SLj. The second transistor T2 is turned on in response to the fourth scan signal PCLj received through the j-th first scan line SLj, so that the second transistor T2 may transmit the data signal Di transmitted from the data line DLi to the first electrode of the first transistor T1.

The third transistor T3 may include a first electrode connected to the gate electrode of the first transistor T1, a second electrode connected to the second electrode of the first transistor T1, and a gate electrode connected to the j-th first scan line SLj. The third transistor T3 is turned on in response to the first scan signal SCj received through the j-th first scan line SLj to diode-connect the first transistor T1 by connecting the gate electrode and the second electrode of the first transistor T1 to each other.

The fourth transistor T4 includes a first electrode connected to the gate electrode of the first transistor T1, a second electrode connected to the third voltage line VL3 through which the initialization voltage VINT is transmitted, and a gate electrode connected to the j-th first scan line SLj. The fourth transistor T4 may be turned on in response to the first scan signal SCj−1 received through the (j−1)-th first scan line SLj−1 and may perform an initialization operation of initializing the voltage of the gate electrode of the first transistor T1 by transmitting the initialization voltage VINT to the gate electrode of the first transistor T1.

The fifth transistor T5 includes a first electrode connected to the first driving voltage line VL1, a second electrode connected to the first electrode of the first transistor T1, and a gate electrode connected to the emission control line EMLj.

The sixth transistor T6 includes a first electrode connected to the second electrode of the first transistor T1, a second electrode connected to the anode of the light emitting diode ED, and a gate electrode connected to the emission control line EMLj.

The fifth transistor T5 and the sixth transistor T6 are simultaneously turned on in response to the emission control signal EMj received through the emission control line EMLj, such that the first driving voltage ELVDD may be compensated through the diode-connected first transistor T1 and transmitted to the light emitting diode ED.

The seventh transistor T7 includes a first electrode connected to the second electrode of the fourth transistor T4, a second electrode connected to the second electrode of the sixth transistor T6, and a gate electrode connected to the (j+1)-th second scan line SWLj+1.

In such an embodiment, as described above, the one end of the capacitor Cst is connected to the gate electrode of the first transistor T1 and the other end of the capacitor Cst is connected to the first driving voltage line VL1. A cathode of the light emitting diode ED may be connected to the second driving voltage line VL2 for transmitting the second driving voltage ELVSS. The structure of the pixel PXij in embodiments of the invention is not limited to the structure illustrated in FIG. 5, and the number of transistors and the number of capacitors included in one pixel PXij, and a connection relationship may be variously modified.

Figure 6:
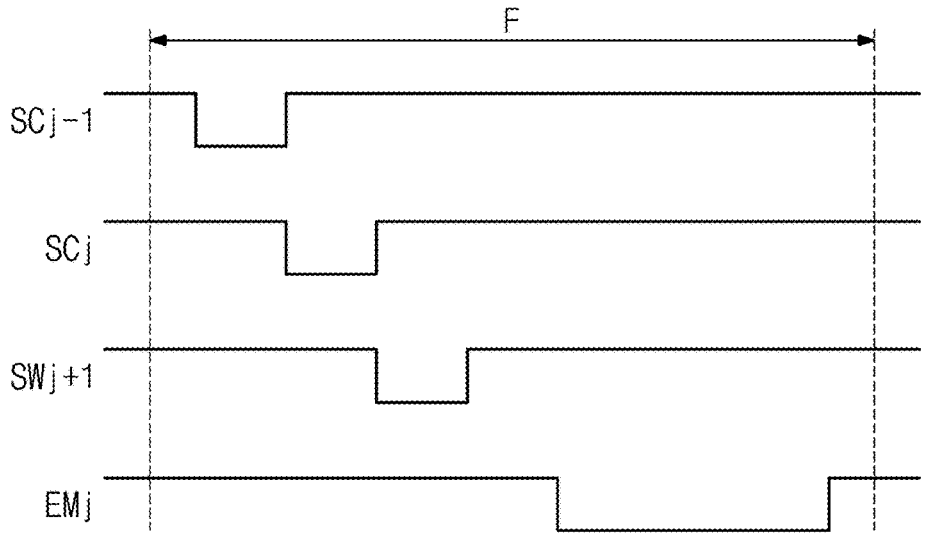
FIG. 6 is a timing diagram illustrating an operation of a pixel of the display device of FIG. 3.

FIG. 6 is a timing diagram illustrating an operation of a pixel of the display device of FIG. 3. An operation of the display device according to an embodiment will be described with reference to FIGS. 5 and 6.

Referring to FIGS. 5 and 6, the (j−1)-th first scan signal SCj−1 of the low level is provided through the (j−1)-th first scan line SLj−1 during the initialization period within one frame F. The fourth transistor T4 is turned on in response to the low-level (j−1)-th first scan signal SCj−1, and the initialization voltage VINT is transmitted to the gate electrode of the first transistor T1 through the fourth transistor T4, so that the first transistor T1 is initialized.

Next, during the data programming and compensation period, when the low-level j-th first scan signal SCj is supplied through the j-th first scan line SLj, the third transistor T3 is turned on. The first transistor T1 is diode-connected by the turned-on third transistor T3 and is biased in the forward direction. In addition, the second transistor T2 is turned on by the low-level j-th first scan signal SCj. Then, the compensation voltage (Di-Vth) reduced by the threshold voltage (Vth) of the first transistor T1 from the data signal (Di) supplied from the data line DLi is applied to the gate electrode of the first transistor T1. That is, the gate voltage applied to the gate electrode of the first transistor T1 may be the compensation voltage (Di-Vth).

A first driving voltage ELVDD and a compensation voltage (Di-Vth) are applied to both ends of the capacitor Cst, and a charge corresponding to a voltage difference between both ends may be stored in the capacitor Cst.

During the data programming and compensation period, the seventh transistor T7 is turned on by receiving the (j+1)-th second scan signal SWLj+1 of the low level through the (j+1)-th second scan line SWLj+1. A portion of the driving current Id may escape through the seventh transistor T7 as a bypass current Ibp by the seventh transistor T7.

Even when the minimum current of the first transistor T1 for displaying a black image flows as the driving current, if the light emitting diode ED emits light, a black image may not be properly displayed. Accordingly, in an embodiment, the seventh transistor T7 in the pixel PXij may distribute a portion of the minimum current of the first transistor T1 as the bypass current Ibp to a current path other than the current path toward the organic light emitting diode. Here, the minimum current of the first transistor T1 means a current under a condition in which the first transistor T1 is turned off because the gate-source voltage (Vgs) of the first transistor T1 is less than the threshold voltage (Vth). In this way, the minimum driving current (e.g., a current of 10 picoampere (pA) or less) under the condition of turning off the first transistor T1 is transmitted to the light emitting diode ED, and is expressed as an image of black luminance. In such an embodiment, when the minimum driving current to display a black image flows, the effect of bypass transmission of the bypass current Ibp may be large, but when a large driving current that displays an image such as a normal or white image flows, there may be little effect of the bypass current Ibp. Therefore, when the driving current for displaying a black image flows, the emission current Ted of the light emitting diode ED, which is reduced by the amount of the bypass current Ibp escaped from the driving current Id through the seventh transistor T7, has the minimum amount of current at a level that may reliably represent a black image. Accordingly, an accurate black luminance image may be implemented using the seventh transistor T7 to improve a contrast ratio. In such an embodiment, the bypass signal is the low-level (j+1)-th second scan signal SWLj+1, but is not limited thereto.

Next, during the emission period, the emission signal EMj supplied from the emission control signal EMLj is changed from the high level to the low level. During the emission period, the fifth transistor T5 and the sixth transistor T6 are turned on by the low-level emission control signal EMj. Then, a driving current Id corresponding to the voltage difference between the gate voltage of the gate electrode of the first transistor T1 and the first driving voltage ELVDD is generated, and the driving current Id is supplied to the light emitting diode ED through the sixth transistor T6, so that the current Ted flows through the light emitting diode ED.

Figure 7:
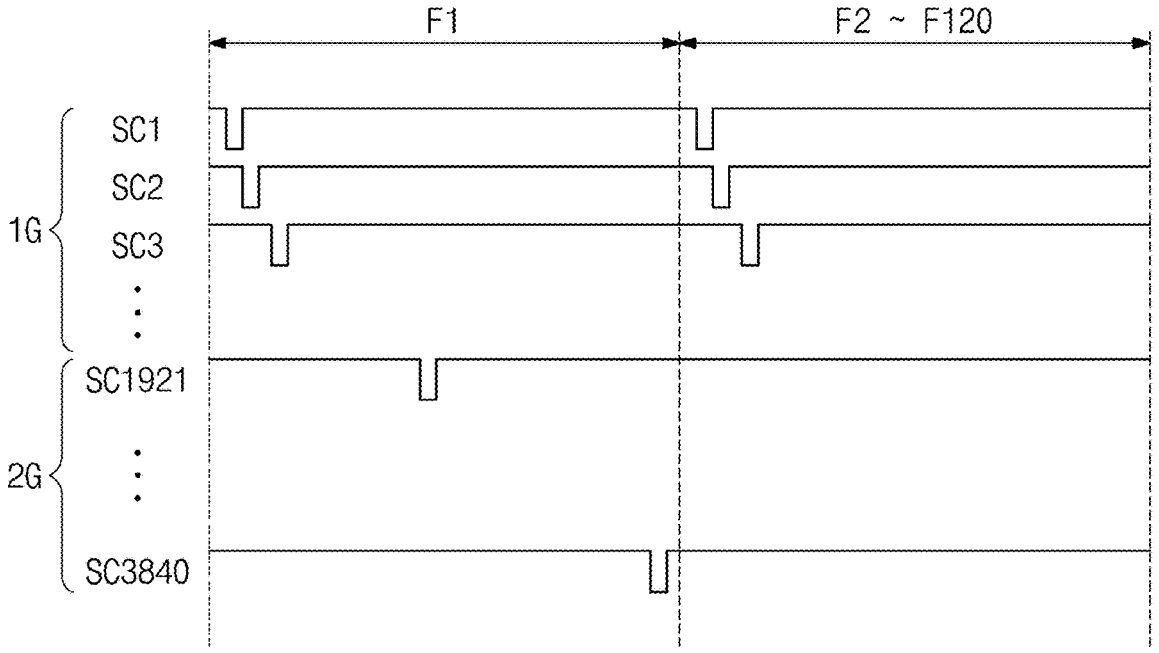
FIG. 7 is a diagram showing an output of a scan driving circuit in a multi-frequency mode.

FIG. 7 is a diagram showing an output of a scan driving circuit in a multi-frequency mode.

FIG. 7 is a diagram illustrating scan signals outputted from a scan driving circuit SD in a multi-frequency mode.

FIG. 7 shows scan signals SC1 to SC3840 outputted from the scan driving circuit SD shown in FIG. 4 when the first frequency of the first display area DA1 (see FIG. 1A) is 120 Hz and the second frequency of the second display area DA2 (see FIG. 1A) is 1 Hz in the multi-frequency mode MFM (see FIG. 3).

In one embodiment, for example, the first display area DA1 illustrated in FIG. 1A may include pixels in rows 1 to 1920, and the second display area DA2 may include pixels in rows 1921 to 3840.

Referring to FIGS. 4 and 7, when the first frequency of the first display area DA1 (see FIG. 1A) is 120 Hz, and the second frequency of the second display area DA2 (see FIG. 1A) is 1 Hz in the multi-frequency mode MFM, the scan signals SC1 to SC3840 corresponding to the first area DA1 and the second area DA2 are sequentially activated to a low level in the first frame F1. From the second frame F2 to the 120th frame F120, only the scan signals SC1 to SC1920 corresponding to the first area DA1 are sequentially activated to a low level.

In such an embodiment, the scan signals SC1 to SC1920 corresponding to the first display area DA1 of the display panel DP (see FIG. 1A) in the scan driving circuit SD are sequentially activated in all frames F1 to F120, and the first image IM1 may be displayed in the first display area DA1. Here, the first image IM1 may be a video.

The scan signals SC1921 to SC3840 corresponding to the second display area DA2 of the display panel DP in the scan driving circuit SD are sequentially activated only in the first frames F1, and the second image IM2 may be displayed in the second display area DA2. The second image IM2 may be a still image.

The scan signals SC1921 to SC3840 corresponding to the second display area DA2 of the display panel DP in the scan driving circuit SD are not activated in the remaining frames F2 to F120 except for the first frame F1. Therefore, in such an embodiment, since only some stages are selectively driven in the scan driving circuit SC, power consumption may be reduced.

Figure 8:
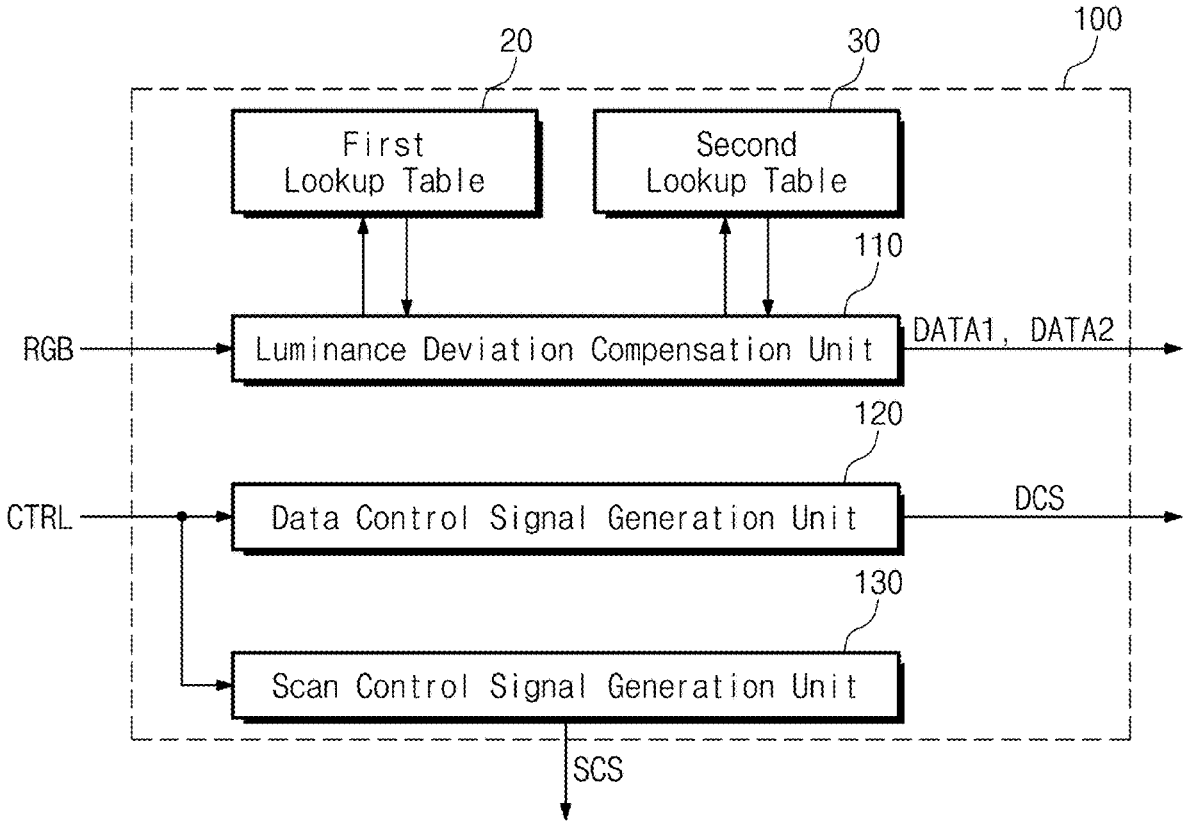
FIG. 8 is a block diagram showing a driving controller according to an embodiment of the invention.

FIG. 8 is a block diagram showing a driving controller according to an embodiment of the invention.

Referring to FIG. 8, an embodiment of the driving controller 100 includes a first lookup table 20, a second lookup table 30, a luminance deviation compensation unit 110, a data control signal generation unit 120, and a scan control signal generation unit 130.

The first lookup table 20 and the second lookup table 30 may be disposed in the driving controller 100 or may be disposed outside the driving controller 100. The first lookup table 20 may provide the first image data signal DATA1 to the luminance deviation compensation unit 110 based on the image signal RGB. The second lookup table 30 may provide a second image data signal DATA2 to the luminance deviation compensation unit 110.

The luminance deviation compensation unit 110 may receive an image signal RGB from an outside, and compensate for the luminance deviation of the first display area DA1 (see FIG. 1A) and the second display area DA2 (see FIG. 1A) to output and provide the compensated first image data signal DATA1 and the second image data signal DATA2 to the data driving circuit 200.

Referring to FIGS. 1A to 7, the first display area DA1 of the display panel DA may be driven at a first frequency of 120 Hz with one frame of 1/120 second and the second display area DA2 may be driven at a second frequency of 1 Hz with one frame of 1/1 second. The data voltage may be charged in the pixels of the first display area DA1 when the thin film transistor is turned on by the scan signals SC1 to SC1920 of the first group 1G, and the luminance of the pixel may gradually increase to have a maximum value. Thereafter, when the transistor is turned off, the charged data voltage continues to be discharged until the data voltage of the next frame is charged, and the luminance of the pixel has a minimum value. The data voltage may be charged in the pixel of the second display area DA when the thin film transistor is turned on by the scan signals SC1921 to SC3840 of the second group 2G and the luminance of the pixel may gradually increase to have a maximum value. Thereafter, when the transistor is turned off, the charged data voltage continues to be discharged until the data voltage of the next frame is charged, and the luminance of the pixel has a minimum value. Here, since the second display area DA2 has a longer period of one frame than the first display area DA1, the data voltage in the second display area DA2 is discharged more than that of the first display area DA1, and accordingly, a luminance change amount may also appear larger. Accordingly, since the data voltage discharge occurs in the second display area DA2 during 1 second, unlike the first display area DA1 where the data voltage is charged in the next frame after 1/120 second, the luminance of the first display area DA1 and the luminance of the second display area DA2 may initially be the same, but may gradually show a difference, and due to such luminance deviation, such that the boundary between the first display area DA1 and the second display area DA2 may be visually recognized by a viewer. In embodiments of the invention, such luminance deviation is compensated.

In an embodiment, the luminance deviation compensation unit 110 may apply image data signals having different data voltages to the first display area DA1 and the second display area DA2 having different frequencies from each other, to improve the visible luminance deviation between the first display area DA1 driven by the first frequency and the second display area DA2 driven by the second frequency in the multi-frequency mode MFM.

In such an embodiment, when the luminance of the second display area DA2 becomes lower than that of the first display area DA1 in the same grayscale (darker case) due to the deviation of luminance between the first display area DA1 and the second display area DA2 by the frequency difference, the luminance deviation is compensated by lowering the data voltage of the second image data signal DATA2 applied to the second display area DA2 driven at the second frequency to the data voltage of the first image data signal DATA2 applied to the first display area DA1 driven at the first frequency. In such an embodiment, as the data voltage decreases, luminance may increase.

In an embodiment, the luminance deviation compensation unit 110 receives the first image data signal DATA1 from the first lookup table 20 and outputs the first image data signal DATA1 when the image signal RGB is not a still image signal. When the image signal RGB is determined as a still image signal, the luminance deviation compensation unit 110 may receive the second image data signal DATA2 from the second lookup table 30 and output the second image data signal DATA2 to the data driving circuit 200.

The data control signal generation unit 120 and the scan control signal generation unit 130 may receive a control signal CTRL from outside. The control signal CTRL may include a vertical synchronization signal, a horizontal synchronization signal, a data enable signal, a clock signal, and the like. The data control signal generation unit 120 may generate a data control signal DCS for controlling the data driving circuit 200 in response to the control signal CTRL and output the data control signal DCS to the data driving circuit 200. The data control signal DCS, for example, may include source start pulse signal, source sampling clock signal, source output enable signal, polarity signal, and the like.

The scan control signal generation unit 130 may generate a scan control signal SCS for controlling the scan driving circuit SD in response to the control signal CTRL and output the scan control signal SCS to the scan driving circuit SD. The scan control signal SCS may sequentially generate scan signals, but may control the first group 1G and the second group 2G to have different frequencies.

Figure 9:
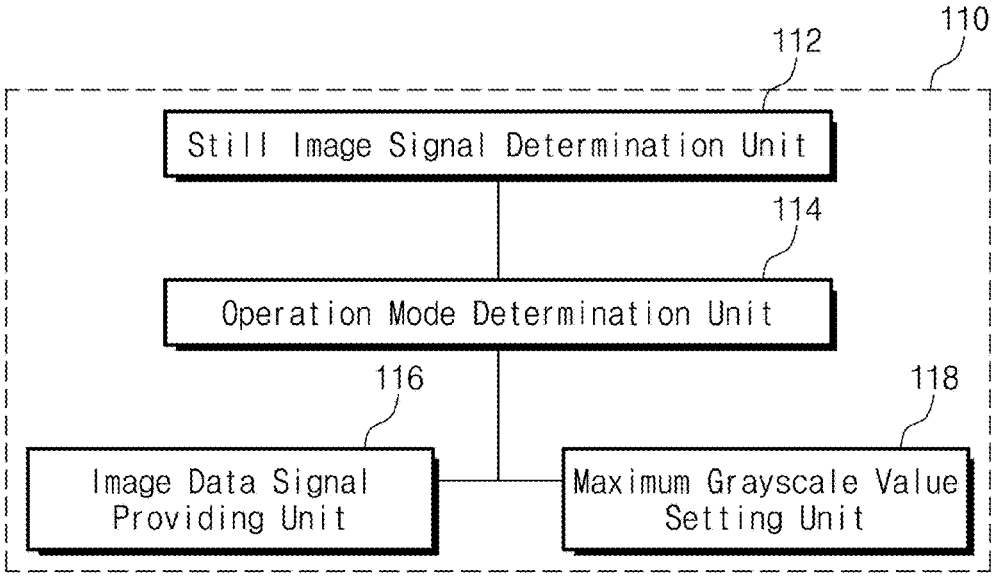
FIG. 9 is a block diagram showing a luminance deviation compensation unit according to an embodiment of the invention.
Figure 10:
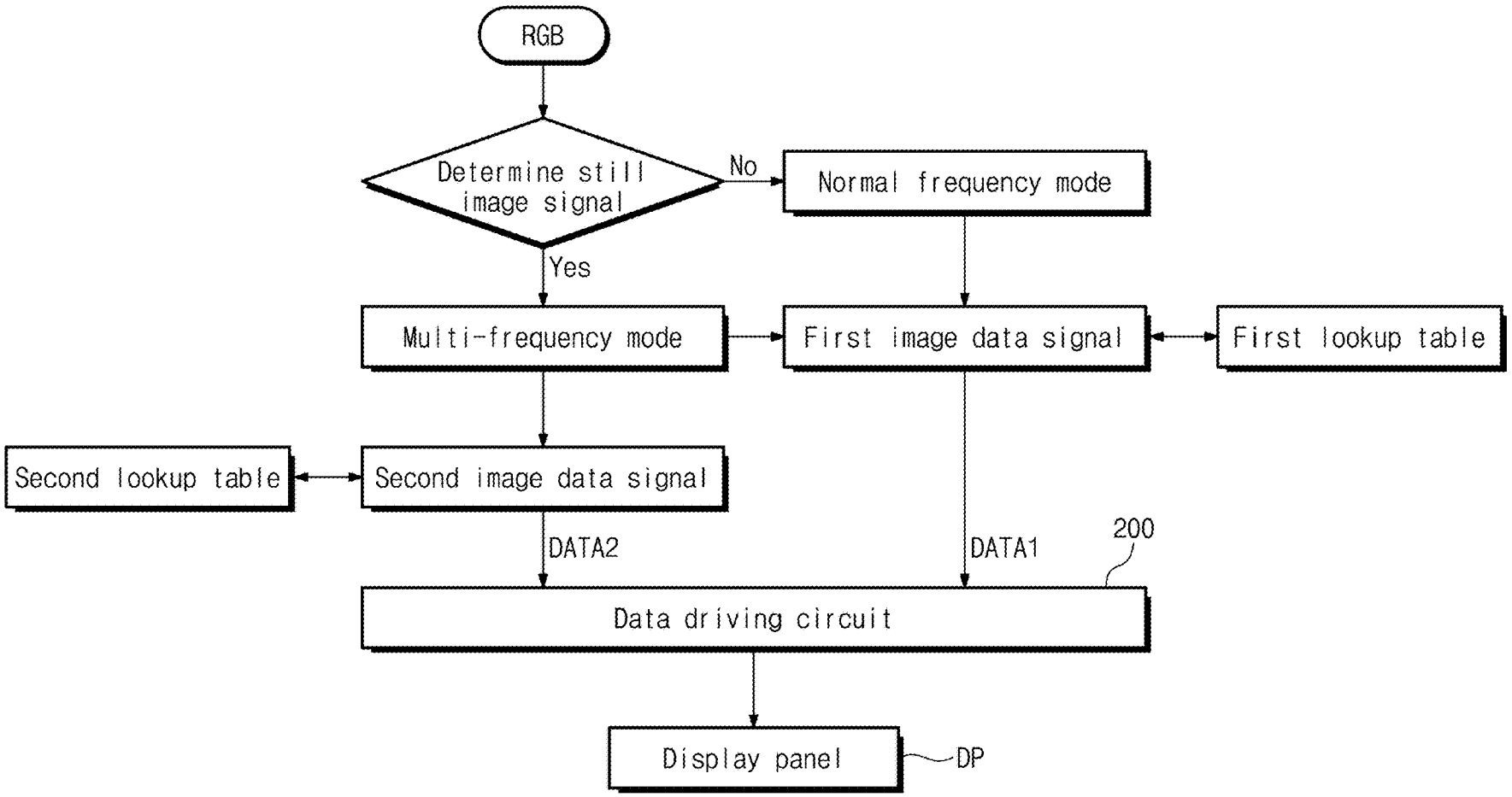
FIG. 10 is a flowchart illustrating a method of driving a display device according to an embodiment of the invention.

FIG. 9 is a block diagram showing a luminance deviation compensation unit according to an embodiment of the invention. FIG. 10 is a flowchart illustrating a method of driving a display device according to an embodiment of the invention.

Referring to FIG. 9, an embodiment of the luminance deviation compensation unit 110 includes a still image signal determination unit 112, an operation mode determination unit 114, an image data signal providing unit 116, and a maximum grayscale value setting unit 118.

In an embodiment, as shown in FIGS. 9 and 10, the still image signal determination unit 112 compares the image signal RGB of a current frame and a previous frame to determine whether the received image signal RGB includes a still image signal. In one embodiment, for example, when a portion of the image signal RGB of the previous frame and the portion of the image signal RGB of the current frame are the same as each other, it may be determined that the received image signal RGB includes a still image signal. In such an embodiment, when the image signal RGB of the previous frame and the image signal RGB of the current frame are entirely different from each other, it may be determined that the received image signal RGB is a video signal.

The operation mode determination unit 114 may determine an operation mode based on whether the received image signal RGB is a video signal or includes a still image signal. In one embodiment, for example, when it is determined that the received image signal is a video signal, the operation mode determination unit 114 determines the operation mode as the normal frequency mode NFM (see FIG. 2), and when it is determined that the received image signal includes a still image signal, the operation mode determination unit 114 may determine the operation mode as the multi-frequency mode MFM (see FIG. 3).

The image data signal providing unit 116 may provide the first image data signal DATA1 to the data driving circuit 200 in the normal frequency mode NFM. That is, the image data signal providing unit 116 may provide the same first image data signal DATA1 to the first display area DA1 and the second display area DA2 of the display panel DP every frame during the normal frequency mode.

When the operation mode is the multi-frequency mode MFM, the image data signal providing unit 116 may provide a first image data signal DATA1 to a first display area DA1 of the display panel DP, and provide a second image data signal DATA2 to the second display area DA2. That is, the image data signal providing unit 116 provides, to the second display area DA2 that is driven at a second frequency or a low frequency (e.g., 1 Hz) to display a still image, the second image data signal DATA2 having a different data voltage from the first image data signal DATA1 provided to the first display area DA1 that is driven at a first frequency or a high frequency (e.g., 120 Hz) to display a video.

The image data signal providing unit 116 receives the first image data signal DATA1 from the first lookup table 20 and the second image data signal DATA2 from the second lookup table 30.

The data driving circuit 200 may receive the first image data signal DATA1 and the second image data signal DATA2 having different data voltages from each other, convert the first and second image data signals DATA1 and DATA2 into data signals, respectively, and provide the data signals to the first display area DA1 and the second display area DA2 of the display panel DP.

Figure 11:
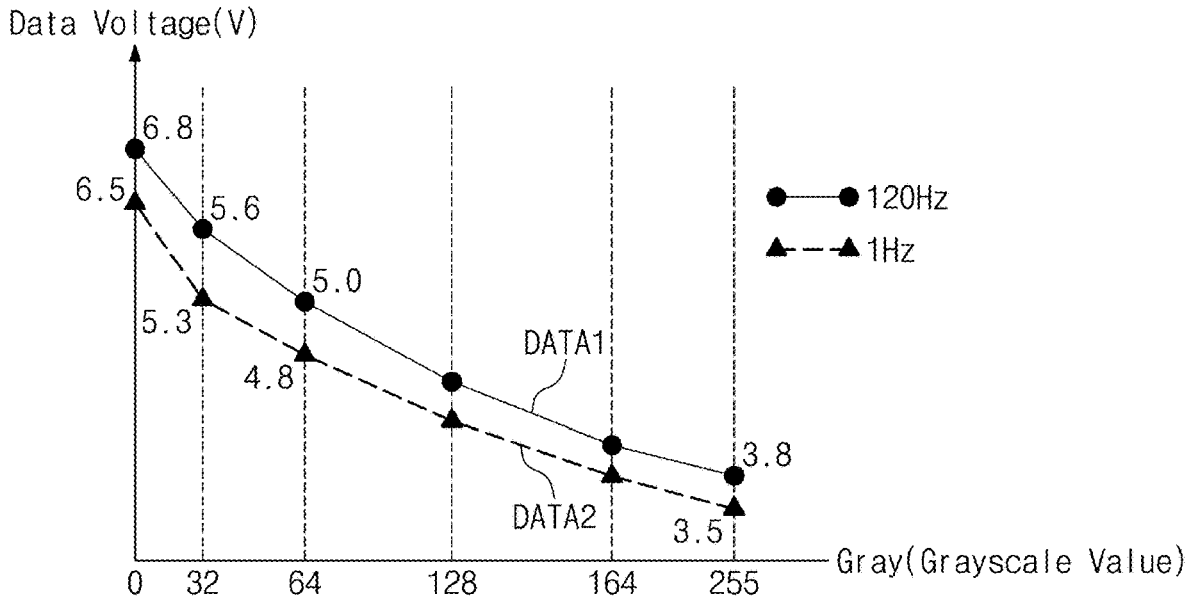
FIG. 11 is a graph showing data voltages for each frequency in a multi-frequency mode.

FIG. 11 is a graph showing data voltages for each frequency in a multi-frequency mode.

FIG. 11 shows different data voltages respectively applied to an area where a video driven by a high frequency is displayed and an area where a still image driven by a low frequency is displayed.

In an embodiment, as shown in FIG. 11, the data voltages of the second image data signal DATA2 applied to the second display area DA2 (see FIG. 1A) are lower than the data voltages of the first image data signal DATA1 applied for each grayscale to the first display area DA1 (see FIG. 1A) driven at the first frequency (e.g., 120 Hz). In one embodiment, for example, the data voltage of the second image data signal DATA2 applied to the second display area DA2 driven at 1 Hz with a grayscale value of 255 is about 3.5V, and the data voltage of the first image data signal DATA1 applied to the first display area DA1 driven at 120 Hz is about 3.8V.

In embodiments of the invention, a data voltage lower than that of the first display area DA1 driven by a high frequency is applied to the second display area DA2 driven by a low frequency, such that reduced luminance in a low frequency area due to a current leaking during the multi-frequency mode MFM driving may be effectively compensated.

In an alternative embodiment, although not shown in the graph of FIG. 11*a* data voltage higher than the first display area DA1 driven by high frequency may be applied to the second display area DA2 driven by the low frequency according to the direction of leakage current in the multi-frequency mode MFM. In such an embodiment, the increased luminance in the low frequency area may be compensated.

Figure 12:
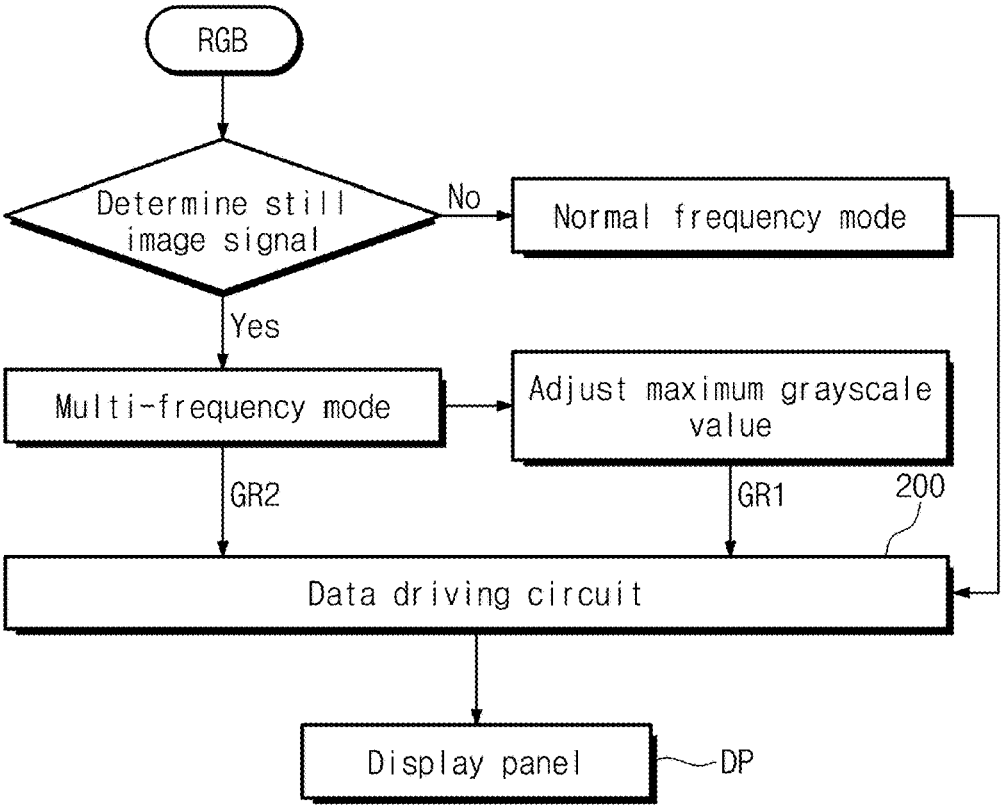
FIG. 12 is a flowchart illustrating a method of driving a display device according to an alternative embodiment of the invention.

FIG. 12 is a flowchart illustrating a method of driving a display device according to an alternative embodiment of the invention.

In an embodiment, as shown in FIG. 12, the driving controller 100 may set different maximum grayscale values of each of the first display area and the second display area according to the operation mode. The driving controller 100 may change the maximum grayscale value of the high frequency area (or the first display area) or the low frequency area (or the second display area) so that the luminance of the first display area and the second display area have a same target luminance. In one embodiment, for example, if the target luminance is 420 nit and the luminance of the first display area and the luminance of the second display area are different from each other in the multi-frequency mode, in the case where the second maximum grayscale value of the second display area where the still image is displayed is 255, the driving controller 100 may lower the first maximum grayscale value of the first display area where the video is displayed to 240. That is, when the maximum grayscale value of the first display area and the second display area is equal to 255 in the multi-frequency mode, since the luminance of the first display area is higher than that of the second display area at the maximum grayscale, the driving controller may lower the first maximum grayscale value of the first display area to 240 to compensate for such luminance difference.

In such an embodiment, the luminance deviation compensation unit 110 of the driving controller 100 may include a maximum grayscale value setting unit 118. The maximum grayscale value setting unit 118 may set different maximum grayscale values of the first display area and the second display area based on the image signal RGB received from the driving controller 100.

In such an embodiment, as described with reference to FIGS. 4, 8, 9 and 12, when the image signal RGB received by the still image signal determination unit 112 is determined as a still image signal, the operation mode determination unit 114 may determine the operation mode of the driving controller 100 as a multi-frequency mode MFM.

In an embodiment, when the operation mode of the driving controller 100 is determined as the multi-frequency mode MFM, the maximum grayscale value setting unit 118 may set a maximum grayscale value of an area having high luminance in the first display area or the second display area to be lower than a maximum grayscale value of an area having low luminance.

In one embodiment, for example, the maximum grayscale value setting unit 118 may set the first maximum grayscale value GR1 of the first display area to be lower than the second maximum grayscale value GR2 of the second display area. The driving controller 100 may provide, to the data driving circuit 200, a first image data signal having a data voltage corresponding to the first maximum grayscale value GR1 and a second image data signal having a data voltage corresponding to the second maximum grayscale value GR2.

Figure 13:
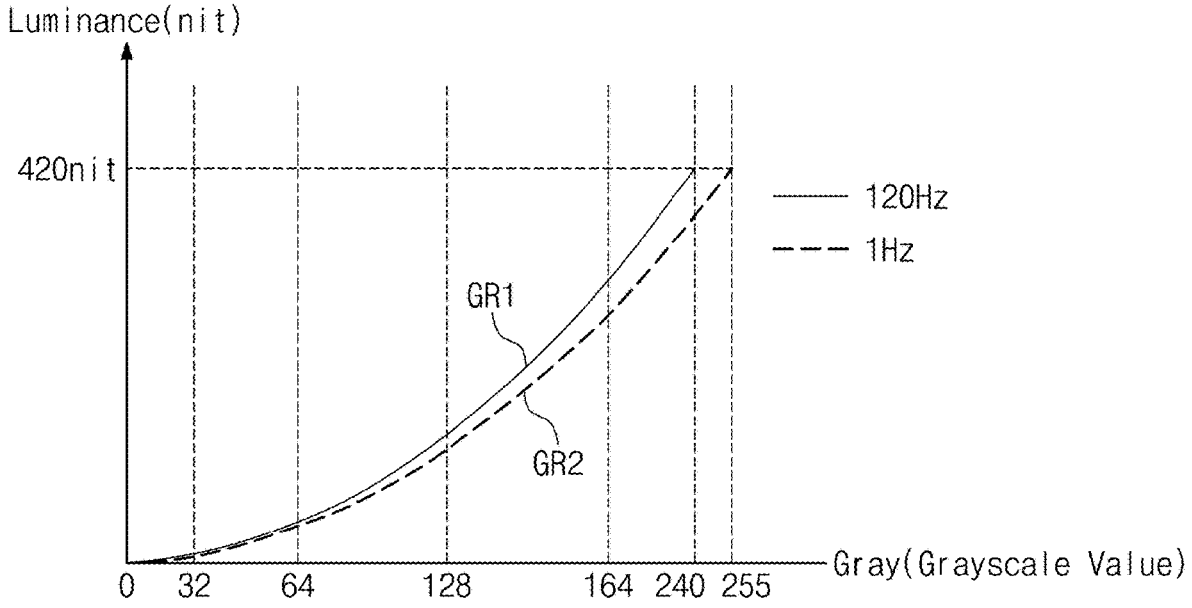
FIG. 13 is a graph showing a maximum grayscale value for each frequency according to an embodiment of the invention.

FIG. 13 is a graph showing a maximum grayscale value for each frequency according to an embodiment of the invention.

In an embodiment, as shown in FIG. 13, the target luminance values of the first and second display areas may be 420 nit, the first maximum grayscale value GR1 of the first display area driven by high frequency (e.g., 120 Hz) may be 240, and the second maximum grayscale value GR2 of the second display area driven at a low frequency (e.g., 1 Hz) may be 255.

In such an embodiment, if the maximum grayscale value of the high frequency driving area is the same as the maximum grayscale value of the low frequency driving area, the luminance of the high-frequency driving area is higher than that of the low-frequency driving area. In one embodiment, for example, as shown in FIG. 13, if the first maximum grayscale value GR1 of the first display area, which is a video display area driven at 120 Hz, is equal to 255, that is, the second maximum grayscale value GR2, the luminance corresponding to the maximum grayscale value of the first display area may exceed 420 nits.

Accordingly, an embodiment of the driving controller 100 according to the invention sets the first maximum grayscale value GR1 to 240 to be lower than the second maximum grayscale value GR2 which is 255, so that the luminance deviation may be compensated by making luminance values in the grayscale corresponding to the first and second display areas the same as each other.

In an alternative embodiment, the luminance deviation occurs in which the luminance of the first display area driven at 120 Hz may be lower than the luminance of the second display area driven at 1 Hz according to the multi-frequency mode. In such an embodiment, the first maximum grayscale value GR1 of the first display area may be maintained at 255, and the second maximum grayscale value GR2 of the second display area may be lowered to 240.

In embodiments of a display device and a driving method thereof according to the invention, as described herein, in the multi-frequency driving mode, a luminance deviation occurring between a first display area displaying a video and a second display area displaying a still image may be reduced.

In embodiments of a display device and a driving method thereof according to the invention, a difference in luminance between the first and second display areas may be compensated by differentially applying data voltages to the first and second display areas driven at different frequencies.

In embodiments of a display device and a driving method thereof according to the invention, the difference in luminance between the first display area and the second display area may be compensated by differentially applying a maximum grayscale value for each frequency.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims

What is claimed is:

1. A display device comprising:

a display panel including a plurality of pixels connected to a plurality of data lines and a plurality of scan lines, wherein a first display area and a second display area adjacent to the first display area are defined in the display panel;

a data driving circuit which drives the plurality of data lines;

a scan driving circuit which drives the plurality of scan lines; and a driving controller which receives an image signal and a control signal, and controls the data driving circuit and the scan driving circuit based on an operation mode, wherein the driving controller comprises a luminance deviation compensation unit which compensates for luminance deviation of the first display area and the second display area when the operation mode is a multi-frequency mode in which the first display area is driven at a first frequency and the second display area is driven at a second frequency different from the first frequency.

2. The display device of claim 1, wherein the driving controller further comprises a first lookup table and a second lookup table each provides image data signals to the luminance deviation compensation unit, wherein the image data signals from the first lookup table correspond to the first display area, and wherein the image data signals from the second lookup table correspond to the second display area.

3. The display device of claim 2, wherein the first lookup table provides a first image data signal corresponding to the first frequency, wherein the second lookup table provides a second image data signal corresponding to the second frequency.

4. The display device of claim 3, wherein the driving controller determines the operation mode as the multi-frequency mode when the received image signal includes a video signal and a still image signal, wherein the luminance deviation compensation unit provides the first image data signal to the first display area of the display panel, in which a video corresponding to the video signal is displayed, and provides the second image data signal to the second display area of the display panel, in which a still image corresponding to the still image signal is displayed, in the multi-frequency mode.

5. The display device of claim 4, wherein the first frequency is greater than the second frequency, and a voltage of the first image data signal is greater than a voltage of the second image data signal.

6. The display device of claim 1, wherein when the operation mode is a normal frequency mode, the driving controller drives both of the first display area and the second display area at the first frequency every frame during the normal frequency mode, and provides a first image data signal corresponding to the first frequency to the first display area and the second display area of the display panel.

7. The display device of claim 1, wherein the luminance deviation compensation unit comprises:

a still image signal determination unit which detects a video signal and a still image signal from the received image signal;

an operation mode determination unit which determines the operation mode as a multi-frequency mode when it is determined that the received image signal includes the video signal and the still image signal; and an image data signal providing unit which provides different image data signals to the first display area and the second display area, respectively, when the operation mode is determined as the multi-frequency mode.

8. The display device of claim 7, wherein the still image signal determination unit determines the still image signal by comparing the image signal of a previous frame with the image signal of a current frame.

9. The display device of claim 7, wherein in the multi-frequency mode, the display device displays a video corresponding to the video signal in the first display area and displays a still image corresponding to the still image signal in the second display area.

10. The display device of claim 9, wherein the image data signal providing unit provides a first image data signal to the first display area and a second image data signal to the second display area, wherein a data voltage of the second image data signal is less than a data voltage of the first image data signal.

11. The display device of claim 7, wherein the driving controller further comprises a first lookup table which provides a first image data signal, and a second lookup table which provides a second image data signal to the luminance deviation compensation unit, and wherein the image data signal providing unit provides the first image data signal from the first lookup table to the first display area of the display panel and provides the second image data signal from the second lookup table to the second display area.

12. The display device of claim 7, wherein when it is determined that the received image signal does not include the still image signal, the operation mode determination unit determines the operation mode as a normal frequency mode in which both of the first display area and the second display area are driven at the first frequency every frame, wherein the image data signal providing unit provides a first image data signal corresponding to the first frequency to the first display area and the second display area of the display panel.

13. A display device comprising:

a display panel including a plurality of pixels connected to a plurality of data lines and a plurality of scan lines;

a data driving circuit which drives the plurality of data lines;

a scan driving circuit which drives the plurality of scan lines; and a driving controller which receives an image signal and a control signal and controls the data driving circuit and the scan driving circuit to display an image on the display panel, wherein the driving controller divides the display panel into a first display area driven at a first frequency and a second display area driven at a second frequency lower than the first frequency based on the image signal, and sets a first maximum grayscale value applied to the first display area and a second maximum grayscale value applied to the second display area differently from each other.

14. The display device of claim 13, wherein when a still image signal is detected from the image signal, the driving controller determines an operation mode as a multi-frequency mode.

15. The display device of claim 14, wherein the driving controller changes the first maximum grayscale value or the second maximum grayscale value based on a target luminance value in the multi-frequency mode.

16. The display device of claim 15, wherein the driving controller provides a first image data signal corresponding to the first maximum grayscale value and a second image data signal corresponding to the second maximum grayscale value to the data driving circuit.

17. The display device of claim 13, wherein the display panel is foldable based on a folding axis extending in a predetermined direction in a folding area.

18. A method of driving a display device, the method comprising:

performing an image data signal receiving operation by receiving, by a luminance deviation compensation unit, a first image data signal and a second image data signal to compensate for a luminance deviation occurring between a first display area of a display panel driven at a first frequency and a second display area of the display panel driven at a second frequency different from the first frequency; and performing an image data signal providing operation by providing, by the luminance deviation compensation unit, the first image data signal and the second image data signal to the first display area and the second display area of the display panel, respectively.

19. The method of claim 18, wherein the performing the image data signal receiving operation comprises:

detecting, by a still image signal determination unit, a still image signal among image signals received by a driving controller;

determining, by an operation mode determination unit, an operation mode of the driving controller as a multi-frequency mode when the still image signal is detected; and receiving, by an image data signal providing unit, the first image data signal from a first lookup table and providing the first image data signal to the first display area, and receiving, by the image data signal providing unit, the second image data signal from a second lookup table and providing the second image data signal to the second display area when the multi-frequency mode is determined.

20. The method of claim 18, wherein the performing the image data signal providing operation comprises:

converting the first image data signal and the second image data signal into a first image data voltage and a second image data voltage, respectively; and applying the first image data voltage and the second image data voltage to the first display area and the second display area of the display panel, respectively.

* * * * *